United States Patent [19]

Edwards

[11] 4,103,733

[45] Aug. 1, 1978

[54] MANUFACTURE OF FOUNDRY CORES AND MOULDS

[75] Inventor: Albert Edwards, Ailsworth, England

[73] Assignee: Baker Perkins Holdings Limited, Peterborough, England

[21] Appl. No.: 682,469

[22] Filed: May 3, 1976

[30] Foreign Application Priority Data

May 1, 1975 [GB] United Kingdom ..... 18257/75

[51] Int. Cl.[2] ..... B22C 9/12; B22C 15/22; B22C 15/28

[52] U.S. Cl. ..... 164/160; 164/195; 164/200

[58] Field of Search ..... 164/7, 160, 200, 325, 164/228, 253, 255, 257, 259, 326, 258, 63, 65, 85, 296, 254

[56] References Cited

U.S. PATENT DOCUMENTS

| | | | |
|---|---|---|---|
| 2,563,643 | 8/1951 | DeRanek | 164/7 |
| 2,825,945 | 3/1958 | Ulrech et al. | 164/258 |
| 3,059,294 | 10/1962 | Dunn | 164/7 |
| 3,305,901 | 2/1967 | Gero | 164/256 X |
| 3,843,301 | 10/1974 | Hijikata | 164/160 X |

*Primary Examiner*—Francis S. Husar
*Assistant Examiner*—John S. Brown
*Attorney, Agent, or Firm*—Learman & McCulloch

[57] ABSTRACT

A method and apparatus for preparing foundry moulds or cores from a cold-setting sand based foundry mixture. The foundry mixture is introduced to a mould or core box and during setting of the mixture in the box suction is applied to the box to accelerate the setting time.

7 Claims, 3 Drawing Figures

MANUFACTURE OF FOUNDRY CORES AND MOULDS

This invention relates to the manufacture of foundry cores and moulds and in particular to the cold-setting type using chemically bonded moulding sand mixtures.

Known cold setting processes for the manufacture of foundry moulds and cores entail the use of a mould or core mixture comprising foundry sand, a resin binder, and an acid catalyst for promoting a setting reaction between the sand and binder. In recent years attention has been focused on chemically based methods of reducing the setting time of the mixture and great advances have been made in this direction by variation of the strength, quantity and type of catalysts used. The stage has been reached at which the setting time of the mixture, once the catalyst and resin are brought together, has been reduced to such an extent that special precautions have had to be taken to prevent setting of the mixture prior to its being introduced to a mould or core box. Normally separate charges of sand and catalyst on the one hand and sand and binder on the other hand have been prepared and the separate charges have been brought together for a rapid final mixing and substantially immediate discharge into a mould or core box. This process has necessitated the design of relatively elaborate equipment compared to that required for mixtures having slower setting times.

One object of the present invention is to provide a non-chemically based method and means for accelerating the setting time of cold-setting foundry mixtures and another object of the invention is to improve the efficiency of the mould and core box filling operation in any mould or core blowing or shooting process.

Whilst the invention is particularly suitable for cold-setting mixtures having relatively longer setting times it can also nevertheless find application to mixtures with the shorter setting times.

The invention provides in one of its aspects a method and apparatus for use in the production of foundry moulds and cores by any mould or core blowing or shooting process in which for filling a mould or core box, means is provided for introducing a moulding mixture to the box under pressure, conveniently by blowing the mixture into the box whilst simultaneously applying suction to the box. This aspect of the invention is directed towards improving the efficiency of the filling operation as will become apparent hereinafter.

The invention provides in another quite independent aspect a method and apparatus for use in the production of foundry moulds and cores by a cold setting process in which means is provided for applying suction to a mould or core box during setting of a foundry sand mixture within the box. It has been found that by applying suction to the box during setting of the mixture, the setting time of the mixture can be dramatically reduced. For example, by applying suction of the order of 26 – 28 inches mercury a 50% reduction in setting time can be achieved. This second aspect of the invention in contrast to the first aspect, is primarily suited to mixtures having the slower setting times and it may make possible the reduction in setting times to an extent that slower setting mixtures needing less elaborate mixing and mould filling apparatus than the quicker setting mixtures can nevertheless achieve similar setting times.

In a preferred system filling of a box using pressure and applied suction according to the first aspect of the ivention is followed by setting of the mixture in the box whilst maintaining the suction i.e. using the second aspect of the invention.

The invention will now be described, by way of example, with reference to the accompanying drawings in which.

Figure 1:
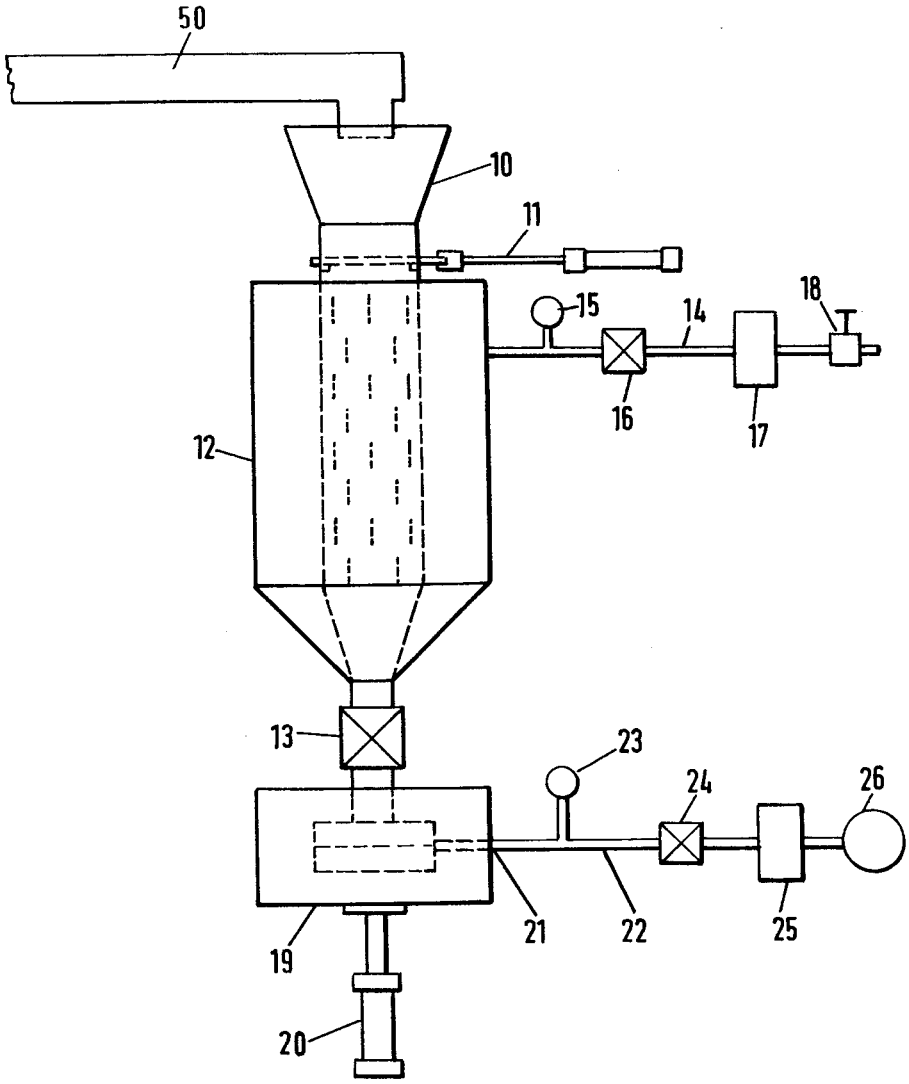
FIG. 1 is a diagrammatic side view of apparatus for preparing foundry moulds or cores.

A cold-setting sand, binder and catalyst mixture having a relatively slow setting time is mixed in a "Ribbon-Flo" mixer 50 for example, as described in U.K. Patent Specification No. 1051651. After mixing, the mixture is discharged into a storage hopper 10, see particularly FIG. 1, having a slide valve 11 in its base. Situated below the hopper 10 is a blowing or shooting chamber 12 with a sand discharge valve 13. An air line 14 having a pressure switch 15, a valve 16, a reservoir 17 and a pressure regulator 18 controls the air flow to the blowing chamber 12 as will later be described. A core or mould box 19 is positioned beneath the chamber 12 and sealed to the lower surface of discharge valve 13 by a piston and cylinder assembly 20. Associated with the box 19, having a vent hole 21, is a suction line 22 with a suction switch 23, a valve 24, a reservoir 25 and a vacuum pump 26.

Figure 2:
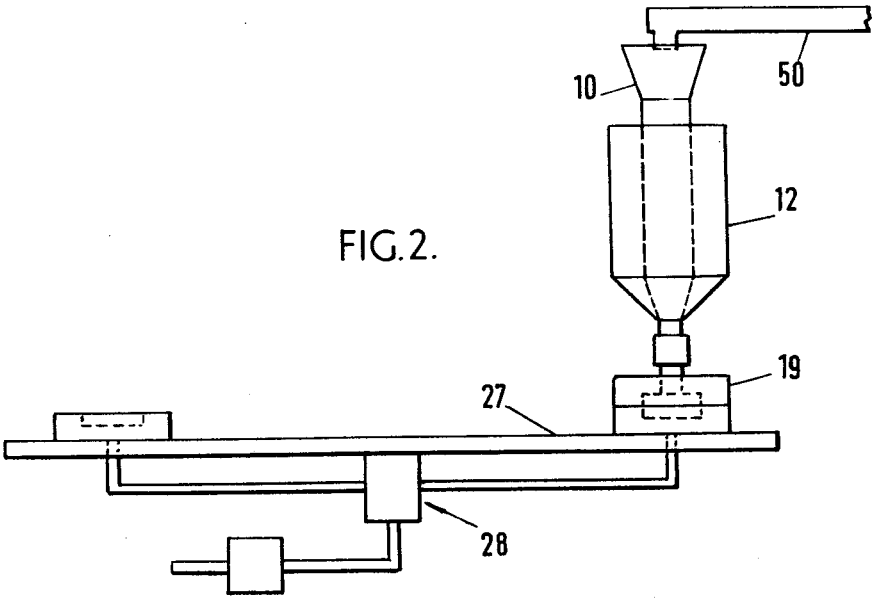
FIG. 2 is a diagrammatic side view of the apparatus incorporated in an automatic plant.
Figure 3:
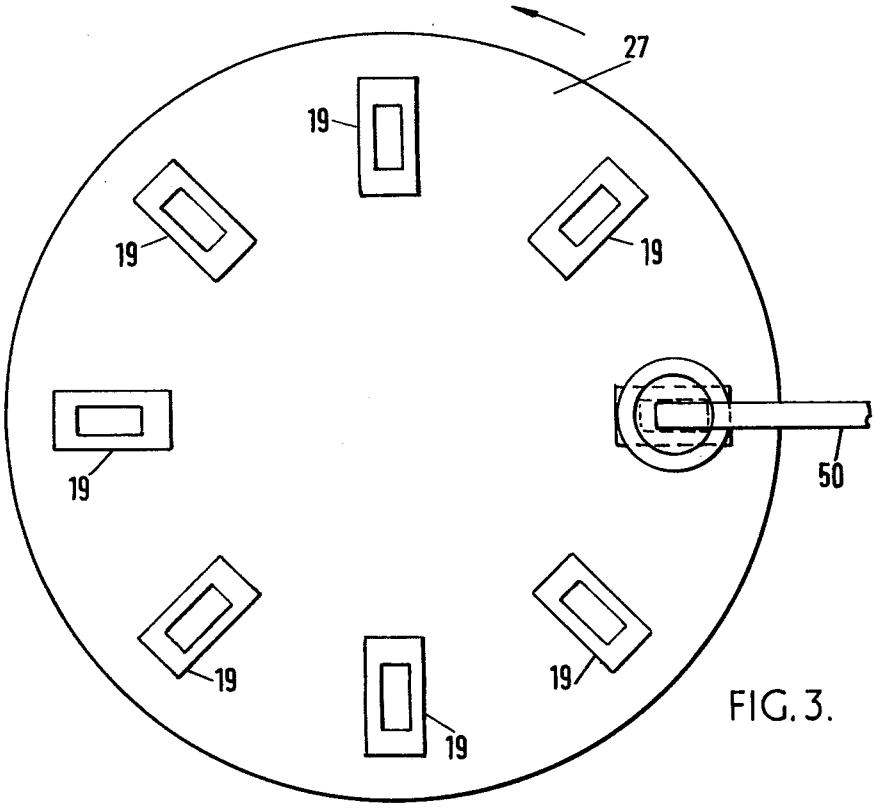
FIG. 3 is a diagrammatic plan view of the plant shown in FIG. 2.

In operation, assuming the blowing chamber 12 is filled with the sand mixture, a core box 19 is clamped against the underside of discharge valve 13 and the slide valve 11 closed. Valve 24 is opened, thus allowing the box 19 to be connected to a source of suction from pump 26 to create a vacuum in box 19. Upon reaching the desired vacuum conditions in box 19, e.g. 26 to 28 inches mercury, the suction switch 23 actuates the valve 24 to close and valve 26 to open. At a predetermined pressure in chamber 12 the pressure switch 15 actuates valve 13 to open and allows the sand mixture to enter the box 19. When the box 19 is filled, the valve 16 which is a three way type is actuated to exhaust the chamber 12 to atmosphere. After about 10 seconds of maintaining the vacuum conditions the valve 13 is closed and piston and cylinder assembly 20 operated to unclamp the box 19 and break the seal. At this stage the filling or charging cycle is completed but suction conditions are maintained in the box to shorten the "setting off" period of the core or mould. This can be achieved by providing a rotary arrangement, for example, as shown in FIGS. 2 and 3. The rotary table 27 includes a suction applying system 28 with branches for a number of core boxes positioned on the table, the system 28 being akin to the system shown in FIG. 1. In this case, after the filling cycle is completed, the table 27 is indexed to the next station at which the suction is still applied to the core or mould box and air at ambient temperature (or warm air for example at 80° F) is thereby allowed to pass through the mixture. After indexing through several stations, during which time suction conditions are maintained, through the various branches of system 28 which rotate with the table, the core or mould sets off. The suction is broken and the core or mould removed by either mechanical means or manually. The whole cycle of operations is now completed.

It will, of course, be appreciated that provided suction conditions are maintained during the "setting off" period, as an alternative to the rotary arrangement, an "in-line" process can be employed or the core or mould boxed can be placed on a bench or the foundry floor for a predetermined set-time.

It has been found that by applying suction conditions to chemically bonded sand, the strength of the finished core or mould appreciably increases at a quicker rate in comparison with the rate under normal atmospheric setting conditions. It follows that with the present invention the core or mould can be stripped from the box in a much shorter time and therefore converts the known type of slow cold-setting process into a more rapid one.

Further features of the above described process are considered to be as follows:

(1) less waste of material in that only the required amount to manufacture a core or mould is used.
(2) elimination of venting apart from that necessary to apply vacuum as previously described.
(3) ability to manufacture several cores or moulds from one charge in the core-shooter chamber because of the employment of a comparatively slow setting chemically bonded sand mixture.
(4) core or mould boxes of weaker construction may be used in that the suction conditions present no resistance to the inflow of sand mixture i.e. lower pressure can be employed to propel the mixture into the box.
(5) in view of the low velocity fill less wear occurs on the core box or pattern.
(6) the problems of incorrect venting are substantially eliminated, resulting in a reduction of scrap cores and moulds
(7) the present process lends itself to producing more intricate shaped cores and moulds.
(8) the pressure/suction filling can equally be applied to any core or mould blowing or shooting process.

I claim:

1. Apparatus for preparing foundry molds or cores from a cold setting sand based molding mixture comprising an indexing table having a plurality of locations thereon for mold or core boxes, a suction system positioned beneath said table and having a plurality of branches movable with said table upon indexing movement thereof and operatively connected to the respective ones of said plurality of locations, and suction valve means in said suction system for conditioning said suction system to constantly apply suction to boxes positioned at said locations on said table as said table is indexed through a plurality of work stations.

2. Apparatus as defined in claim 1 wherein one of said work stations is a filling station, a blowing chamber mounted above said table at said filling station for holding a supply of said molding mixture, and means for discharging a charge of said mixture under pressure from said chamber into a box located on said table at said filling station while said suction system is applying suction to the last mentioned box.

3. The invention defined in claim 2 wherein said boxes are open at their tops, and said means for discharging include means for sealing said blowing chamber to the top of said last mentioned box at said filling station, means for supplying gas under pressure to said chamber, and means for releasing the box from the blowing chamber subsequent to the filling of said last mentioned box with said mixture.

4. The invention defined in claim 3 wherein said suction valve means conditions said suction system to continuously apply suction to said last mentioned box for a predetermined number of indexing movements of said table subsequent to the filling of the last mentioned box with said mixture to induce a flow of air through the open top of said box and said mixture in said box to accelerate the setting thereof.

5. Apparatus for filling a foundry mold box or core box with a sand-based cold setting molding mixture consisting of sand mixed with a binder and a catalyst for accelerating the setting reaction between the sand and binder, said apparatus comprising a blowing chamber for introducing the mixture to the box by applying a gas under pressure thereto; means connected to said chamber for applying gas under pressure to said chamber; means connected to said blowing chamber for supplying said mixture to the blowing chamber; valve means connected to said gas applying means for ceasing the application of the gas under pressure and thereby terminating filling of the box; and suction creating means connected to said box and operable to apply suction to the box during the filling thereof and to continue to apply suction to the mold or box after the ceasing of the application of said gas and termination of the filling thereof to accelerate chemical setting of the mixture.

6. Apparatus as set forth in claim 5 in which means operatively associated with said box is provided for releasably sealing said chamber to the top of said box and for releasing the box from the blowing chamber following operation of the valve means to terminate filling and while said suction means continues to apply suction to the box.

7. Apparatus as set forth in claim 5 wherein mixture discharge valve means is provided to selectively communicate the blowing chamber with the box, and control means is provided for initially supplying the gas to the blowing chamber for a time to pressurize it prior to the time said discharge valve means is operated to communicate the blowing chamber with the box.

* * * * *